US005743816A

United States Patent [19]

Ohsumi et al.

[11] Patent Number: 5,743,816

[45] Date of Patent: Apr. 28, 1998

[54] SOLID GOLF BALL

[75] Inventors: Shunji Ohsumi; Yasuhiro Fukui; Kenji Baba, all of Kagawa-ken; Hiroyuki Naito, Takamatsu, all of Japan

[73] Assignee: Kasco Corporation, Kagawa-ken, Japan

[21] Appl. No.: 835,023

[22] Filed: Mar. 27, 1997

[30] Foreign Application Priority Data

Apr. 1, 1996 [JP] Japan ..... 8-079203

[51] Int. Cl.[6] ..... A63B 37/06; A63B 37/12

[52] U.S. Cl. ..... 473/376; 473/373; 473/378

[58] Field of Search ..... 473/361, 373, 473/374, 376, 377, 378

[56] References Cited

U.S. PATENT DOCUMENTS

| | | | |
|---|---|---|---|
| 4,431,193 | 2/1984 | Nesbitt | 473/374 |
| 5,273,286 | 12/1993 | Sun | 473/376 X |
| 5,439,227 | 8/1995 | Egashira et al. | 473/377 X |
| 5,674,137 | 10/1997 | Maruko et al. | 473/351 X |
| 5,688,191 | 11/1997 | Cavallaro et al. | 473/373 |

FOREIGN PATENT DOCUMENTS

| | | |
|---|---|---|
| 51-49840 | 4/1976 | Japan . |
| 60-241464 | 11/1985 | Japan . |
| 3-3501 | 1/1991 | Japan . |
| 4-48473 | 8/1992 | Japan . |

*Primary Examiner*—George J. Marlo

*Attorney, Agent, or Firm*—Oblon, Spivak, McClelland, Maier & Neustadt, P.C.

[57] ABSTRACT

A solid golf ball basically comprises a solid core composed of a three-layered structure, and a cover for coating the solid core therewith. The solid core comprises an inner layer, an intermediate layer having a Shore D hardness of 45 to 65, and an outer layer having a hardness lower than that of the intermediate layer. The inner layer has a hardness which is set to be lower than the hardness of the intermediate layer.

7 Claims, 1 Drawing Sheet

SOLID GOLF BALL

BACKGROUND OF THE INVENTION

1. Field of the Invention

The present invention relates to a solid golf ball comprising a solid core composed of a three-layered structure coated with a cover.

2. Description of the Related Art

A two-piece solid golf ball is known, in which a solid core having a single-layered structure is coated with a cover. Such a two-piece solid golf ball provides a certain carry. However, the two-piece solid golf ball has a drawback in that a feeling obtained when the ball is hit is insufficient, and the ball is not controlled well.

In order to replace the two-piece solid golf ball, a three-piece solid golf ball has been developed. The three-piece solid golf ball comprises a solid core and a cover in the same manner as the two-piece solid golf ball. However, the three-piece solid golf ball includes the solid core or the cover which is allowed to have a two-layered structure. Thus the ball has a three-layered structure as a whole. For example, Japanese Laid-Open Patent Publication No. 60-241464 discloses a three-piece solid golf ball comprising a solid core composed of a two-layered structure, in which an inner core has a hardness of 50 to 70 (JIS-C hardness) and an outer core has a hardness of 70 to 90 (JIS-C hardness). Japanese Patent Publication No. 4-48473 discloses a three-piece solid golf ball comprising a cover composed of a two-layered structure, in which an outer layer of the cover has a Shore D hardness of 58 to 72 and a specific gravity of 0.92 to 1.2, and an inner layer of the cover has a Shore D hardness which is not more than that of the outer layer of the cover and a specific gravity of not less than 1.2.

Japanese Laid-Open Patent Publication No. 51-49840 discloses a solid golf ball having a four-layered or more multi-layered structure as a whole. This solid golf ball is constructed such that a larger weight is distributed to its core section, and the hardness is successively increased from the inside to the outside. Further, Japanese Patent Publication No. 3-3501 suggests a multi-piece solid golf ball having a core designed such that a larger weight is distributed to outer sections.

As described above, various types of golf balls have been hitherto developed and suggested to replace the two-piece solid golf ball. However, in the present circumstances, any of the conventional golf balls fails to sufficiently dissolve the drawback involved in the two-piece solid golf ball.

Namely, in the case of the golf ball disclosed in Japanese Laid-Open Patent Publication No. 60-241464, the hitting feeling is not necessarily improved because of the influence exerted by the hardness of the outer core. In the case of the golf ball disclosed in Japanese Patent Publication No. 4-48473, it is difficult to improve the hitting feeling by softening the inner layer of the cover because the impact force upon hitting the ball is large due to the low hardness of the inner layer of the cover having a large specific gravity. Similarly, the hitting feeling is not improved in the case of the golf ball disclosed in Japanese Patent Publication No. 3-3501. In the case of the golf ball disclosed in Japanese Laid-Open Patent Publication No. 51-49840, the resilience is unsatisfactory, and an obtained carry is only in a degree equivalent to that obtained by a yarn-wound golf ball because the core section having a low hardness has a large diameter.

SUMMARY OF THE INVENTION

A general object of the present invention is to provide a solid golf ball which makes it possible to provide a sufficient carry, and sufficiently improve the hitting feeling and the control performance.

A principal object of the present invention is to provide a solid golf ball which makes it possible to enhance the resilience.

Another object of the present invention is to provide a solid golf ball which makes it possible to sufficiently improve the hitting feeling and the control performance obtained upon an approach shot especially when the ball is hit by using an iron club.

Still another object of the present invention is to provide a solid golf ball excellent in durability, which makes it possible to sufficiently improve the hitting feeling and the control performance.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
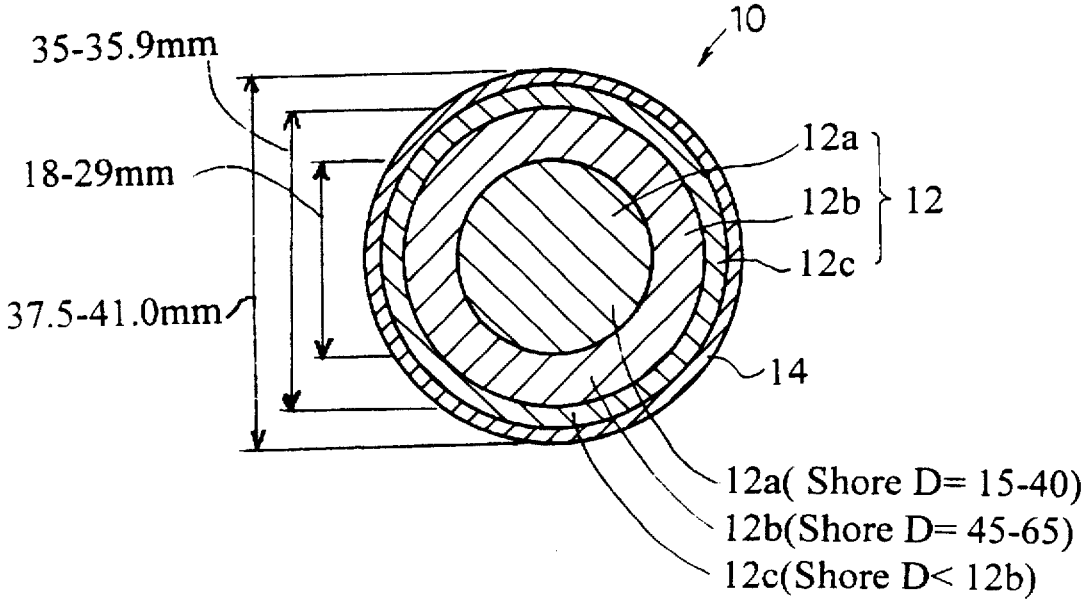
FIG. 1 shows a cross-sectional structure of a solid golf ball.

FIG. 1 shows a cross-sectional structure of a solid golf ball 10 according to the present invention. The solid golf ball 10 basically comprises a solid core 12 composed of a three-layered structure, and a cover 14 for coating the solid core 12 therewith.

The size (diameter or thickness), the hardness, and other factors of respective layers of the solid core 12 have been investigated concerning the solid golf ball 10 obtained by coating the solid core 12 having the three-layered structure with the cover 14. As a result, a carry equivalent to those provided by the conventional two-piece and three-piece solid golf balls has been obtained, and sufficiently satisfactory hitting feeling and control performance have been obtained by setting the hardness of an intermediate layer **12*b* to be relatively high, and setting the hardness of an outer layer 12*c* to be lower than the hardness of the intermediate layer 12*b***. Especially, the hitting feeling and the control performance have been improved, for example, when an approach shot is made by using an iron club.

Usually, each of the layers of the solid core 12 having the three-layered structure is formed by using a rubber composition composed of a base material of natural and/or synthetic rubber. However, each of the layers of the solid core 12 may be formed by using a material comprising, for example, an ionomer resin and/or a thermoplastic elastomer such as those composed of styrene, olefin, urethane, ester, and amide.

As for the hardness of each of the layers of the solid core 12, the hardness of the intermediate layer **12*b* is set to be a Shore D hardness of 45 to 65, and the hardness of the outer layer 12*c* is made lower than the hardness of the intermediate layer 12*b*. If the hardness of the intermediate layer 12*b* is lower than a Shore D hardness of 45, the resilience is deteriorated, and a sufficient carry is not provided. On the other hand, if the hardness of the intermediate layer 12*b*** is higher than a shore D hardness of 65, the hitting feeling is deteriorated.

If the hardness of the outer layer **12*c* is higher than the hardness of the intermediate layer 12*b*, the hitting feeling is deteriorated due to the influence of the hardness of the outer layer 12c. Further, the ball is separated from a surface of a club face at an early timing, and consequently the control performance is deteriorated. Therefore, it is necessary that the hardness of the intermediate layer 12b is limited to be a Shore D hardness of 45 to 65, and the hardness of the outer layer 12c is set to be lower than the hardness of the intermediate layer 12b**.

In the present invention, the obtainable resilience becomes high, and a certain carry is readily provided by setting the hardness of an inner layer 12b to be a Shore D hardness of 15 to 40. However, the hardness of the inner layer 12a is not limited to the foregoing range.

Preferably, the weight of the solid core 12 is distributed such that the inner layer 12a has a relatively large specific gravity, and the intermediate layer 12b and the outer layer 12c have relatively small specific gravities. However, there is no limitation thereto.

In the present invention, the ball has good durability when the solid core 12 has a diameter of 37.5 to 41 mm, the inner layer 12a has a diameter of 18 to 29 mm, and the two-layered core comprising the inner layer 12a coated with the intermediate layer 12b has a diameter of 35 to 39.5 mm. However, the foregoing ranges may be altered to some extent.

Usually, an ionomer resin or a material containing it is used for a cover 14 for coating the solid core 12 having the three-layered structure. The thickness of the cover 14 is approximately the same as the thickness of the cover of the conventional two-piece and three-piece solid golf balls.

EXAMPLES 1 TO 5 AND COMPARATIVE EXAMPLES 2 AND 3

Rubber compositions for inner layers 12a, intermediate layers 12b, and outer layers 12c blended as shown in Table 1 were used to obtain solid cores 12 of the three-layered structure having diameters, weights, and hardnesses as shown for Examples 1 to 5 and Comparative Examples 2 and 3 in Table 2. The solid cores 12 concerning Examples 1 to 3 and Comparative Example 2 had a specific gravity of the inner layer 12a of about 1.38, a specific gravity of the intermediate layer 12b of about 1.06, and a specific gravity of the outer layer 12c of about 1.10. The solid cores 12 concerning Example 4 and Comparative Example 3 had a specific gravity of the inner layer 12a of about 1.28, a specific gravity of the intermediate layer 12b of about 1.12, and a specific gravity of the outer layer 12c of about 1.10. The solid cores 12 concerning Example 5 had a specific gravity of the inner layer 12a of about 1.38, a specific gravity of the intermediate layer 12b of about 1.10, and a specific gravity of the outer layer 12c of about 1.01.

The obtained solid cores 12 were covered with a resin composition for a cover 14 prepared by blending 1.5 part by weight of titanium dioxide to 100 parts by weight of an ionomer resin 100, followed by being subjected to polishing and painting to produce solid golf balls 10 concerning Examples 1 to 5 and Comparative Examples 2 and 3. The cover 14 had a Shore D hardness of 68.

COMPARATIVE EXAMPLE 1

A conventional two-piece solid golf ball was produced as follows. Namely, a solid core having a single-layered structure was obtained by using a rubber composition blended as shown in Table 1, which was then coated with the resin composition for the cover used in Examples 1 to 5 and Comparative Examples 2 and 3, followed by being subjected to polishing and painting.

Table 2 shows the resilience, the carry, the hitting feeling, and the control performance obtained by using the solid golf balls concerning Examples 1 to 5 and Comparative Examples 1 to 3.

As shown in Table 2, the solid golf balls concerning Examples 1 to 5 provided carries approximately the same as that provided by using the conventional two-piece solid golf ball concerning Comparative Example 1. Namely, the carries provided by the solid golf balls concerning Examples 1 to 5 were 176.9 to 178. 1 m. Further, the solid golf balls concerning Examples 1 to 5 were evaluated to be excellent in hitting feeling and control performance.

On the contrary, the two-piece solid golf ball concerning Comparative Example 1 was deficient in hitting feeling and control performance. The solid golf ball concerning Comparative Example 2 was sufficient in hitting feeling and control performance, however, an obtained carry was 173.2 m. Namely, the solid golf ball concerning Comparative Example 2 failed in providing a sufficient carry. The solid golf ball concerning Comparative Example 3 was deficient in hitting feeling and control performance.

TABLE 1

| | Example (parts by weight) | | | | | Comparative Example (parts by weight) | | |
|---|---|---|---|---|---|---|---|---|
| | 1 | 2 | 3 | 4 | 5 | 1 | 2 | 3 |
| Rubber composition for inner layer | | | | | | | | |
| Polybutadiene | 100 | 100 | 100 | 100 | 100 | 100 | 100 | 100 |
| Zinc acrylate | 8 | 8 | 8 | 8 | 10 | 33 | 8 | 8 |
| Zinc oxide | 64 | 64 | 64 | 48 | 64 | 20 | 64 | 48 |
| Anti-aging agent | 0.5 | 0.5 | 0.5 | 0.5 | 0.5 | 0.5 | 0.5 | 0.5 |
| Peroxide | 3 | 3 | 3 | 3 | 3 | 3 | 3 | 3 |
| Rubber composition for intermediate layer | | | | | | | | |
| Polybutadiene | 100 | 100 | 100 | 100 | 100 | | 100 | 100 |
| Zinc acrylate | 33 | 36 | 28 | 30 | 30 | | 20 | 30 |
| Zinc oxide | 5 | 4 | 7 | 16 | 14 | | 12 | 16 |
| Anti-aging agent | 0.5 | 0.5 | 0.5 | 0.5 | 0.5 | | 0.5 | 0.5 |
| Peroxide | 3 | 3 | 3 | 3 | 3 | | 3 | 3 |
| Rubber composition for outer layer | | | | | | | | |
| Polybutadiene | 100 | 100 | 100 | 100 | | | 100 | 100 |
| Zinc acrylate | 8 | 8 | 8 | 17 | | | 8 | 33 |
| Zinc oxide | 18 | 18 | 18 | 18 | | | 18 | 12 |
| Anti-aging agent | 0.5 | 0.5 | 0.5 | 0.5 | | | 0.5 | 0.5 |
| Peroxide | 3 | 3 | 3 | 3 | | | 3 | 3 |
| Thermoplastic polyamide elastomer | | | | | 90 | | | |
| Himilan 1605 | | | | | 10 | | | |

TABLE 2

| | | | Example | | | | | Comparative Example | | |
|---|---|---|---|---|---|---|---|---|---|---|
| | | | 1 | 2 | 3 | 4 | 5 | 1 | 2 | 3 |
| Core | Diameter (mm) | Inner layer | 25.0 | 25.0 | 25.0 | 25.0 | 25.0 | 38.3 | 25.0 | 25.0 |
| | | Two-layered core | 36.6 | 36.6 | 36.6 | 36.6 | 36.6 | | 36.6 | 36.6 |
| | | Three-layered core | 39.0 | 39.0 | 39.0 | 39.0 | 39.0 | | 39.0 | 39.0 |
| | Weight (g) | Inner layer | 11.3 | 11.3 | 11.2 | 10.5 | 11.3 | 35.1 | 11.3 | 10.5 |
| | | Two-layered core | 29.8 | 29.8 | 29.8 | 30.0 | 30.7 | | 29.8 | 30.0 |
| | | Three-layered core | 35.7 | 35.7 | 35.8 | 36.0 | 35.9 | | 35.7 | 36.0 |
| | Hardness (Shore D) | Inner layer | 32 | 32 | 31 | 31 | 32 | 53 | 32 | 31 |
| | | Intermediate layer | 53 | 62 | 46 | 50 | 52 | | 40 | 50 |
| | | Outer layer | <53 | <62 | <46 | <50 | <52 | | <40 | 54 |
| Cover | Thickness (mm) | | 1.9 | 1.9 | 1.9 | 1.8 | 1.9 | 2.0 | 1.9 | 1.8 |
| Ball | Diameter (mm) | | 42.8 | 42.8 | 42.8 | 42.7 | 42.8 | 42.8 | 42.8 | 42.7 |
| | Weight (g) | | 45.3 | 45.3 | 45.3 | 45.3 | 45.4 | 45.2 | 45.3 | 45.3 |
| | Resilience *1 | | 99.5 | 99.8 | 99.3 | 99.3 | 99.5 | 100 | 98.8 | 100.2 |
| | Carry (m) *2 | | 177.3 | 178.1 | 177.0 | 176.9 | 177.0 | 178.2 | 173.2 | 178.4 |
| | Hitting feeling *3 | Wood #1 | ◎ | ○ | ◎ | ◎ | ◎ | Δ | ○ | Δ |
| | | Iron #9 | ◎ | ◎ | ◎ | ◎ | ◎ | X | ◎ | X |
| | Control performance *4 | | ○ | ○ | ○ | ○ | ○ | X | ○ | X |

In Table 2, symbols are as follows:
*1 (resilience): initial velocity of the golf ball obtained by striking the ball by using a swing robot with a wood No. 1 club (#1), represented by indexes with respect to an index obtained for Comparative Example 1, the index obtained for Comparative Example 1 being regarded as 100;
*2 (carry): measured by striking the ball by using a swing robot with a wood No. 1 club (#1) at a club head speed of 40 m/sec;
*3 (hitting feeling): evaluated by hitting the ball by an expert golfer (man) with a wood No. 1 club (#1) and an iron No. 9 club (#9); ◎: extremely good, ○: good, Δ: fairly bad, X: bad;
*4 (control performance): evaluated by making approach shots by an expert golfer (man) with an iron club; ○: good, X: bad.

What is claimed is:

1. A solid golf ball comprising a solid core having a three-layered structure composed of an inner layer, an intermediate layer formed outside said inner layer, and an outer layer formed outside said intermediate layer, and a cover for coating said solid core, wherein:

said inner layer is designed to have a Shore D hardness which is lower than that of said intermediate layer;

said intermediate layer is designed to have a Shore D hardness of 45 to 65; and said outer layer is designed to have a Shore D hardness which is lower than that of said intermediate layer.

2. The solid golf ball according to claim 1, wherein said inner layer has a Shore D hardness of 15 to 40.

3. The solid golf ball according to claim 1, wherein said inner layer has a diameter of 18.0 to 29.0 mm, said intermediate layer and said inner layer have a combined diameter of 35.0 to 39.5 mm, and said outer layer, said inner layer, and said intermediate layer have a combined diameter of 37.5 to 41.0 mm.

4. The solid golf ball according to claim 1, wherein a weight distribution in said solid core is designed so that said inner layer has a large specific gravity, and said intermediate layer and said outer layer have specific gravities which are smaller than said specific gravity of said inner layer.

5. The solid golf ball according to claim 1, wherein said solid core is formed by using a rubber composition comprising a base material composed of natural and/or synthetic rubber.

6. The solid golf ball according to claim 1, wherein at least one layer of said solid core is formed by using a material comprising one selected from ionomer resins and thermoplastic elastomers composed of styrene, olefin, urethane, ester, or amide.

7. The solid golf ball according to claim 1, wherein said cover is formed by using an ionomer resin or a material containing it.

* * * * *

Adverse Decision in Interference

Patent No. 5,743,816, Shunji Ohsumi, Yasuhiro Fukui, Kenji Baba, Hiroyuki Naito, SOLID GOLF BALL, Interference No. 105,612, final judgment adverse to the patentees rendered March 25, 2008, as to claims 1-7.

*(Official Gazette July 29, 2008)*